United States Patent [19]

Keller et al.

[11] 4,154,184

[45] May 15, 1979

[54] APPARATUS AND METHODS FOR MANUFACTURE OF CAN END MEMBER

[75] Inventors: Jerome E. Keller, Lakewood; Ronald L. Moore, Golden, both of Colo.; Harold Cook, Jr., Long View, Wash.

[73] Assignee: Coors Container Company, Golden, Colo.

[21] Appl. No.: 803,647

[22] Filed: Jun. 6, 1977

Related U.S. Application Data

[60] Continuation-in-part of Ser. No. 701,653, Jul. 1, 1976, abandoned, which is a division of Ser. No. 599,812, Jul. 28, 1975, Pat. No. 3,982,657.

[51] Int. Cl.[2] ..... B21D 51/44

[52] U.S. Cl. ..... 113/121 C

[58] Field of Search ..... 113/15 R, 15 A, 121 C; 220/268

[56] References Cited

U.S. PATENT DOCUMENTS

| | | | |
|---|---|---|---|
| 2,012,213 | 8/1935 | Young | 113/120 R |
| 3,397,811 | 8/1968 | Lipske | 113/121 C |
| 3,881,630 | 5/1975 | Lovell et al. | 220/268 |
| 3,929,251 | 12/1975 | Urmston | 113/121 C |
| 3,946,683 | 3/1976 | Jordan | 113/15 A |
| 3,964,414 | 6/1976 | Gane | 113/121 C |
| 4,003,494 | 1/1977 | Smith et al. | 113/121 C |
| 4,027,612 | 6/1977 | Herbst | 113/121 C |

*Primary Examiner*—Michael J. Keenan

*Attorney, Agent, or Firm*—Bruce G. Klaas; Dennis K. Shelton

[57] ABSTRACT

The method of manufacture of a container end member or the like with integral hinged opening tab means thereon having a formed severable tab portion, a formed connecting flange portion extending between the tab portion and the other part of the end member, and first and second formed score groove means located in juxtaposition between the tab portion and the connecting flange portion to provide a fracturable web portion therebetween, and the method comprising: first at least partially forming a central part of the tab portion before forming any other part of the tab means; thereafter initiating the forming of the connecting flange portion and partially forming the connecting flange portion before initiating the forming of any other part of the tab means other than the tab portion; and thereafter initiating the forming of the first and second score groove means and completing the forming of the first and second score groove means while completing the forming of the tab portion and the connecting flange portion.

21 Claims, 19 Drawing Figures

Fig. 1
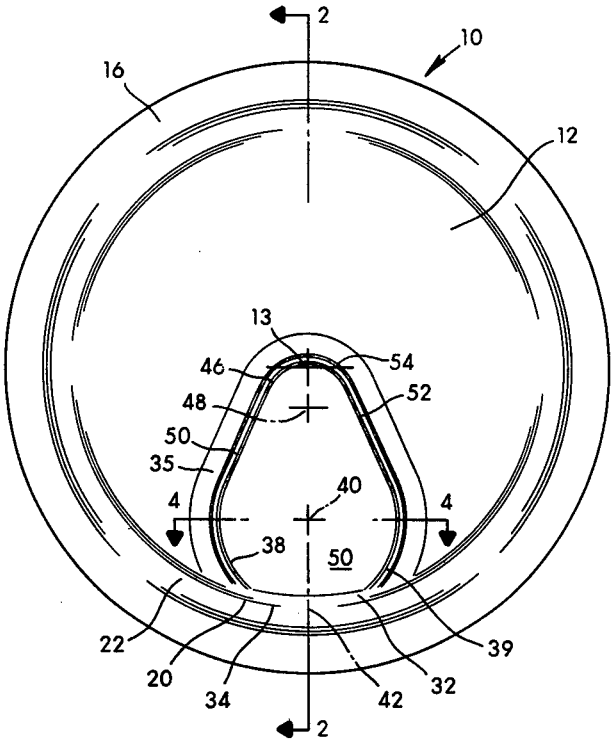
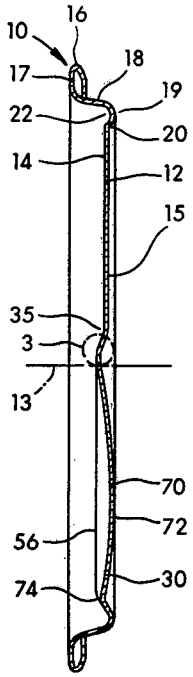
Fig. 2
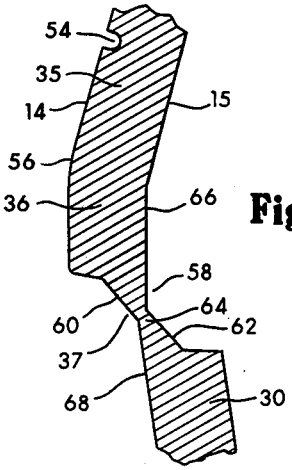
Fig. 3

APPARATUS AND METHODS FOR MANUFACTURE OF CAN END MEMBER

BACKGROUND AND SUMMARY OF THE INVENTION

This application is a continuation-in-part of prior copending U.S. patent application Ser. No. 701,653, filed July 1, 1976, and now abandoned, as a divisional application of prior U.S. patent application Ser. No. 599,812, filed July 28, 1975, now U.S. Pat. No. 3,982,657, the benefit of the filing dates of which are hereby claimed.

This invention relates to apparatus and methods for manufacture of container end members having integral opening devices of the type disclosed in prior U.S. Pat. No. 3,982,657 and in prior filed copending U.S. patent application Ser. No. 800,206 filed May 25, 1977, for ONE PIECE CONTAINER END MEMBER WITH HINGED OPENING TAB PORTION HAVING INDENTATION MEANS THEREON, now U.S. Pat. No. 4,081,104 the disclosures of which are incorporated herein by reference thereto. The invention involves new and improved manufacturing apparatus and methods of the type disclosed in prior U.S. Pat. Nos. 3,912,114; 3,929,251; and 3,946,683, the disclosures of which are incorporated herein by reference.

While various manufacturing apparatus and methods have been suggested for the manufacture of can end members, having integral opening devices employing juxtapositioned score groove means defining a fracturable narrow-width web portion, such as disclosed in U.S. Pat. Nos. 3,912,114 and 3,929,251, the reliable low cost manufacture of such end members has proven difficult to achieve in actual high speed, high production, commercial manufacturing operations. Minor variations in press operation, tooling design, end member materials, and sequence of forming steps have proven to be critical in achieving high volume mass production of such end members which have uniform opening characteristics, including consistent relatively low force opening characteristics, and yet which are not subject to premature fracture during manufacture, handling before and during association with a can body member, and handling and storage after association with a can body member prior to subsequent deliberate opening by the consumer. The present invention provides manufacturing apparatus and methods for such integral opening devices in end members by which reliable, high volume, high speed, manufacturing may be accomplished.

In general, the apparatus and methods of the present invention comprise upper and lower tooling means adapted to be mounted in a press for causing relative continuous movement of the tooling means during a single stroke of the press between an open position, whereat a partially formed end member is placed in a forming position between the upper and lower tooling means, and a closed position whereby the end member is further formed to provide an integral hinged opening tab means thereon. The tooling means are constructed and arranged to implement a method of forming whereby the central part of a tab portion is first at least partially formed before forming any other part of the tab means; thereafter the forming of a connecting flange portion of the tab means being initiated and partially formed before any other part of the tab means other than the central part of the tab portion; thereafter the forming of first and second score groove means located in juxtaposition to provide a fracturable web between the tab portion and the connecting flange portion being initiated and partially formed before any other part of the tab means other than the tab portion and the connecting flange portion; and thereafter, if desired or necessary, the forming of a third score groove means located outwardly of the first and second score groove means in the connecting flange portion being initiated and completed during the completion of the forming of the tab portion, the connecting flange portion, and the first and second score groove means.

BRIEF DESCRIPTION OF DRAWING

The foregoing objectives and results have been attained in illustrative and presently preferred embodiments of the inventive concepts shown on the accompanying drawing in which:

FIG. 1 is a top plan view of a container end member having an integral hinged tab means after manufacture and prior to assembly with a container body member;

FIG. 2 is a cross-sectional view of the container end member of FIG. 1 taken along the line 2—2;

FIG. 3 is an enlarged partial view of a tab portion score area of the container end member of FIG. 1;

DETAILED DESCRIPTION

Figure 4:
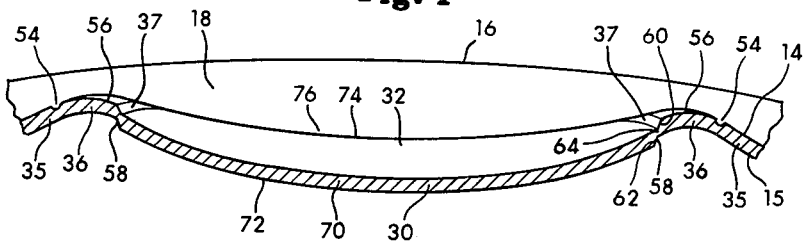
FIG. 4 is an enlarged cross-sectional view of a portion of the container end member of FIG. 1 taken along line 4—4 in FIG. 1.

Referring now to FIGS. 1-4, a one piece container end member 10 formed from a blank of sheet metal material such as, for example, an aluminum alloy of approximately 0.0115 inch thickness, is shown to comprise a central annular end wall portion 12, extending radially transversely at substantially right angles to a central axis 13 to provide outer and inner container surfaces 14, 15 when in association with a can body member. Center portion 12 is axially inwardly offset from an annular exterior rim portion 16 having an axially outwardly facing end surface 17 and integrally connected thereto by a generally axially slightly radially inwardly extending flange portion 18, a rounded interior rim portion 19 located inwardly beyond the center portion 12, and a generally radially inwardly slightly axially extending inclined flange portion 20 defining an annular axially outwardly opening groove 22 between flange portion 18 and center portion 12. While there are certain advantages in the arrangement of the present preferred embodiment, it is to be understood that the center portion 12 may be variously otherwise connected to the rim portion 16 by any suitable connecting flange portion structure.

Container opening tab means are provided in center portion 12 in the form of a partially severable tab portion 30 having a relative wide (i.e., 0.540 inch in the presently preferred embodiment) hinge area 32 extending generally arcuately along the juncture 34 of flange portion 20 with center portion 12. Tab portion 30 is generally axially inwardly offset relative to center portion 12 and connected thereto by an axially outwardly inclined flange portion 35 terminating in a rounded rim portion 36. The peripheral configuration of tab portion 30 is defined by a first peripherally interior score line groove means 37, in outside surface 14 of center portion 12, generally located at the juncture between tab portion 30 and rim portion 36. Groove 37 comprises opposite radially outermost arcuate portions 38, 39 having a common center at 40 on a radial line 42 extending from the central axis 13 of the end member 10; an arcuate radially innermost portion 46 extending slightly beyond the central axis 13 and having a center at 48 on radial line 42; and opposite generally radially extending straight line portions 50, 52 tangentially connected arcuate portions 38, 39, 46. Another peripherally exterior score line groove means 54, referred to as a third score groove means, in the outside surface of center portion 12 is slightly outwardly spaced from groove 37 adjacent the juncture of flange portion 35 and rim portion 36 to provide a relatively narrow width (e.g., 0.0285 inch) land area 56 therebetween which groove 54 and land area 56 have the same general contour as groove 37 so as to extend thereabout in spaced generally parallel relationship therewith. Another score line groove means 58, FIGS. 3 and 4, of the same peripheral configuration as score line groove 37, is located at the juncture of rim portion 36 and tab portion 30 in interior surface 15 of center portion 12 to provide first and second score groove means located in juxtaposition for defining a fracturable web portion therebetween.

As shown in FIG. 3, score line grooves 37, 58 are located in juxtaposition to provide generally parallel inclined surfaces 60, 62, the inner end portions of which may slightly overlap to define a shear area 64, having a relatively narrow width (e.g., 0.0025 inch) transverse to surfaces 60, 62, with the adjacent inner surface 66 of the rim portion 36 being substantially parallel to and slightly inwardly offset (e.g., 0.0005 inch) relative to the adjacent outer surface 68 of the tab portion 30.

Figure 5:
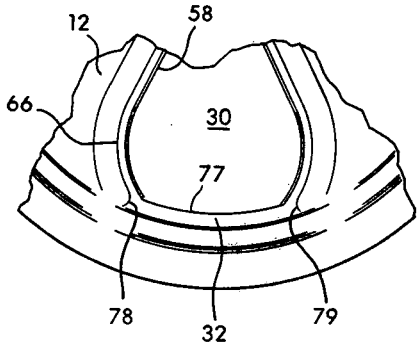
FIG. 5 is a partial bottom plan view of a portion of the container end member of FIG. 1.

As shown in FIGS. 2 and 4, the tab portion 30 is of compound curvature with the central portion 70 along the radial line 42 being furthest axially inwardly displaced relative to rim portion 36 such that the innermost surface area 72 is located approximately in coplanar relationship with rim portion 19. The surface 74, FIG. 5, along the hinge area 32 is axially inwardly offset relative to the land area 56 to provide a saddle-like depression 76. As shown in FIG. 5, the hinge action may be facilitated by a forming line 77 caused by providing a relatively sharp edge on the forming tooling and by outwardly curved terminal portions 78, 79 of the outer edge of the land area 66 adjacent score groove 58. The arcuate score groove portions 38, 39 are arranged so as to terminate radially outwardly adjacent the ends of the hinge area 32 and so that a radially outward extension thereof would intersect an arc extending circumferentially along the hinge area rather than being tangential thereto as in a prior art circular tab portion configuration. As a result, the hinge area has a width sufficient to receive and support a person's finger during opening without coming into contact with any significant portion of the shear area 64 along the score grooves 37, 58.

After the container end member 10 of FIGS. 1-5 has been formed as described hereinabove, central wall portion 12 may be axially outwardly domed so that in the final form of container end member 10 the central portion 12 is generally axially outwardly inclined.

The doming of the center portion 12 provides greater flexibility with the result that the score groove means 37, 54 can withstand a certain amount of flexing of the center portion without being severed to reduce the possibility of inadvertent severance during manufacture, assembly, storage and handling while at the same time enabling deliberate opening by severance under application of less digitally applied forces.

Figure 6:
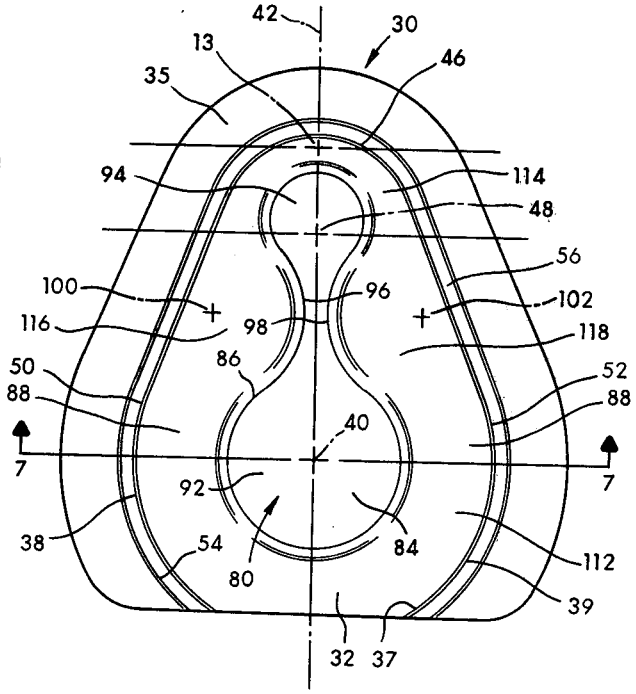
FIG. 6 is an enlarged plan view of an alternative and presently preferred embodiment of the tab means portion of the container end member of FIG. 1.
Figure 7:
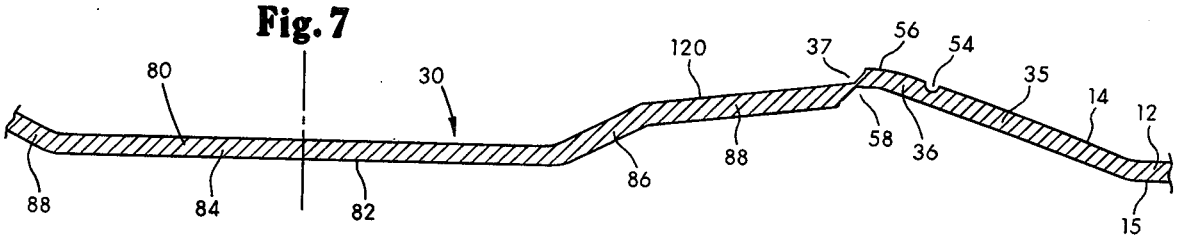
FIG. 7 is an enlarged cross-sectional view of an edge part and center part of the tab portion of the container end member of FIG. 6 taken along the line 7—7.

As shown in FIGS. 6 & 7, in an alternative and presently preferred embodiment the tab portion 30 is axially inwardly offset relative to the rim portion 36 with indentation means 80 in the central portion along the radial line 42 being furthest axially inwardly displaced such that the innermost surface area 82 is generally located approximately in coplanar relationship with the inner surface 15 of the center portion 12.

In general, the presently preferred form of the indentation means 80 has an hour-glass peripheral configuration, and comprises a generally flat bottom wall portion 84, and a continuous formed side wall portion 86 which is slightly inclined and extends generally transversely between the bottom wall portion 84 and a generally flat slightly inclined flange portion 88 extending between the side wall portion 86 and the score grooves 37, 58. The continuous formed side wall portion 86 and the bottom wall portion 84 have peripheral configurations comprising a first generally circular relatively large section 92 located next adjacent the hinge portion 32 with a radius of curvature having a center at 40 on line 42; a second generally circular relatively small section 94 spaced radially inwardly of the first circular section 92 and located next adjacent the central axis 13 with a radius of curvature having a center at 48; and a pair of spaced oppositely curved intermediate connecting sections 96, 98 which extend between and connect the first and second circular sections 92, 94, with radii of curvature having centers at 100, 102. The connecting sections 96, 98 and the circular sections 92, 94 are tangentially connected. The configuration of the indentation means is such as to provide a variable width for connecting flange portion 88 which includes a generally circular relatively wide portion 112 circumjacent circular bottom wall portion 92, a generally circular relatively narrow width portion 114 circumjacent circular bottom wall portion 94, and a pair of enlarged sector portions 116, 118 next adjacent the intermediate straight line portions 50, 52 of the score groove 38.

Thus, in the presently preferred embodiment, the generally flat upper surface 120 of flange portion 88 provides a continuous land area between the side wall portion 86 of the indentation means and the score groove 37 including a pair of oppositely spaced enlarged land area sector portions at 116, 118 which are utilized to provide first and second pressure applying surfaces for initial severance of the score groove 37 along the intermediate straight line portions 50, 52. Arcuate ribs (not shown) may be embossed on the land area sector portions 116, 118 and on the flange portion 35 to define and locate the portions of the score groove 37 to be initially pressed to initially sever the tab portion 30 relative to the end wall portion 12. Suitable indicia such as the arrows, instructions, and numerals, (not shown) may be embossed on the end wall portion 12 to inform the consumer about the preferred opening procedures.

In order to manufacture the aforedescribed container end member 10 of FIGS. 1–5 from sheet metal stock, such as an aluminum alloy, suitably sized blanks of the sheet stock are first formed to provide the exterior rim portion 16, the flange portion 18, the interior rim portion 19, and the flange portion 20, and any markings to be provided on the end member 10 are embossed in the center portion 12 by a press operation. Then the central portion 12 is further formed and scored in a continuous operation to provide, in sequence of initiation of the forming steps, first the formed tab portion 30, then the flange portion 35, then the score groove 37 and the score groove 58, and then the score groove 54, the forming tooling being arranged to sequentially initiate and complete the foregoing further forming and scoring of the center portion during one stroke of a press by which such further forming and scoring is accomplished. As a result, the tab portion is first partially formed which draws sufficient material into the tab portion area to give it strength to prevent buckling. The score groove 54, which preferably may have a relatively large depth of 0.005 inch, serves as a block against any substantial outwardly directed displacement of metal in rim portion 36. The container end member than has the constructional form as hereinbefore described in reference to FIG. 2. The container end member may then be further formed into a shape wherein the central end wall portion 12 is axially outwardly domed. The doming operation may be conveniently performed in conventional container end seal testing apparatus by which the rim portion 16 is fixedly secured and sealed on the test apparatus with the inner surface 15 of the container end member being subject to axially outwardly directed force in the form of high pressure air at, for example, between 50 to 60 p.s.i. which will also enable detection of any defects in the sealable integrity of the container end member such as breaks or insufficiency of strength in the score grooves 37, 58.

Referring now to FIGS. 8–11, the aforedescribed method of manufacture is illustrated by sequential positioning of forming tool means and the tab means portion of the container end member mounted in a forming press, during a single downward stroke of the press. The forming tool means are illustrated by partial cross-sectional view on only one side of a central tooling axis 148, it being understood that the shape and positions of the tool means and the end member are substantially identical on the other sides of the central axis.

In general, the forming tool means comprises an inner centrally positioned first upper forming tool member 150 having a central cavity 152 in which is mounted a second upper forming tool member 154 for forming the central wall portion 70 of tab portion 30; an outer third upper forming tool member 156 having a central cavity 157 for mounting member 150; and a lower forming tool member 158. In the presently preferred embodiment, tool members 150, 154, 156 are relatively axially fixed and supported on the upper platen of a press for uniform continuous downward movement from an upper retracted position (not shown) to variously downwardly displaced forming positions during the downward stroke of the press with the lower tool member 158 being axially fixedly supported on the fixedly positioned lower platen of the press.

The tool member 150 comprises a flat lower surface 160 extending radially outwardly from the central tooling axis toward a transverse peripheral surface 162 and terminating in a first score groove forming edge 164, an upwardly inclined score groove forming surface 166, and a second score groove forming edge 168 which have peripheral configurations corresponding to the outer score groove means 37 and which engage and form a portion of the upper surface 14 of the end member during a portion of the forming operation.

The forming member 154 comprises a lower axially downwardly extending convex surface 170 of compound curvature having a contour corresponding to the contour of the central wall portion 70 of tab portion 30 for engaging and forming a portion of the upper surface 14 of the end member throughout the forming operation. Member 154 may be made of hard plastic material, such as nylon or of metallic material, as a separate member or integral with member 150.

The lower forming surface of member 156 comprises a first flat radially outwardly extending surface 172 which is axially upwardly offset relative to surfaces 160, 164, 166 & 168 to provide a vertically upwardly extending clearance gap 174 thereabout; a curved forming surface 176 on a downwardly projecting rib portion 178 having a peripheral configuration corresponding to the score groove means 58 for engaging a portion of the outer surface 14 of the end member during a portion of the forming operation; a second flat radially outwardly extending surface 180, having a peripheral configuration generally corresponding to flange portion 35, which is axially upwardly offset relative to surfaces 160, 164, 166, 168 & 176 to provide a clearance gap 182 thereabout; a curved downwardly outwardly extending surface 184 having a peripheral configuration generally corresponding to flange portion 35 for engaging and forming a portion of the outer surface 14 of the end member during a portion of the forming operation; and a flat radially outwardly extending surface 186, having a peripheral configuration generally corresponding to flange portion 35, which is axially downwardly offset relative to surfaces 160, 164, 166, 168, 172, 176, 180 &

184, for continuously supporting a portion of the outer surface 14 of the end member during the forming operation.

The tool member 158 comprises a central clearance cavity 188 defined by a side wall surface 190 and having a peripheral configuration generally corresponding to the peripheral configuration of the tab portion 30; a first flat generally radially extending surface 192 transversely intersecting surface 190 to provide a support edge surface 194 for engaging and supporting a portion of the inner surface 15 of the end member during a portion of the forming operation; an upwardly outwardly curved surface 196 terminating in a forming edge 198 for engaging and forming a portion of the inner surface 15 of the end member during a portion of the forming operation; an upwardly outwardly inclined flat score groove forming surface 200 terminating in a score groove forming edge 202 and having a peripheral configuration corresponding to the inner score groove means 58 for engaging and forming a portion of the inner surface 15 of the end member during a portion of the forming operation; an axially uppermost horizontal flat outwardly extending surface 204 for supporting and engaging and forming a portion of the inner surface 15 of the end member during the forming operation and having a peripheral configuration corresponding to the score groove means 37, 58; an axially downwardly outwardly inclined surface 206 having a peripheral configuration generally corresponding to the flange portion 35 and intersecting surface 204 to provide a forming edge 208 for engaging and supporting and forming a portion of the inner surface 15 of the end member during a portion of the forming operation; an axially downwardly outwardly curved surface 210; and a flat radially outwardly extending surface 212 axially downwardly offset relative to surfaces 204, 206, 210 to provide a clearance gap 214 during the forming operation.

Figure 8:
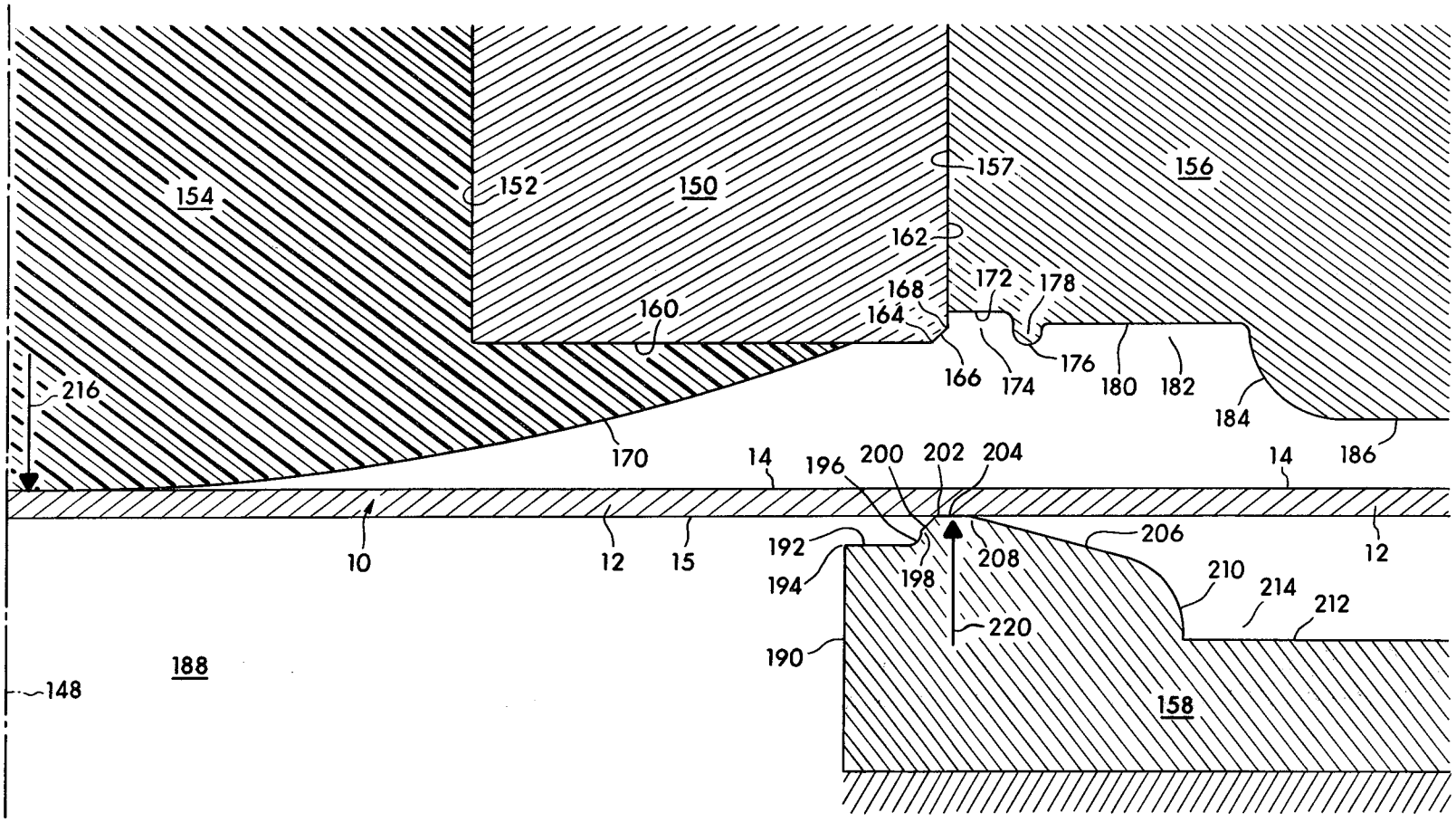
FIG. 8 is a cross-sectional side elevational view of a portion of apparatus for forming the container end member of FIGS. 1-5 in an initial forming position.

As shown in FIG. 8, a partially preformed end member 10 having a flat central wall portion 12 is mounted in proper axially aligned relationship to and between upper tooling members 150, 154, 156 and lower tooling member 158 with the partially formed end member supported on surface 204 of the lower tooling member 158. Then the upper tool members 150, 154, 156 are moved downwardly relative to the lower tool member 158 whereupon the lowermost portion of surface 170 of member 154 first contacts the upper surface 14 of the central panel portion to initiate preforming of the central portion 70 of the tab portion 30 by application of oppositely directed forming forces, as indicated by arrows 216, 220, prior to engagement of any other forming surface of the upper tool members and prior to forming of any other portion of the tab means 30.

Figure 9:
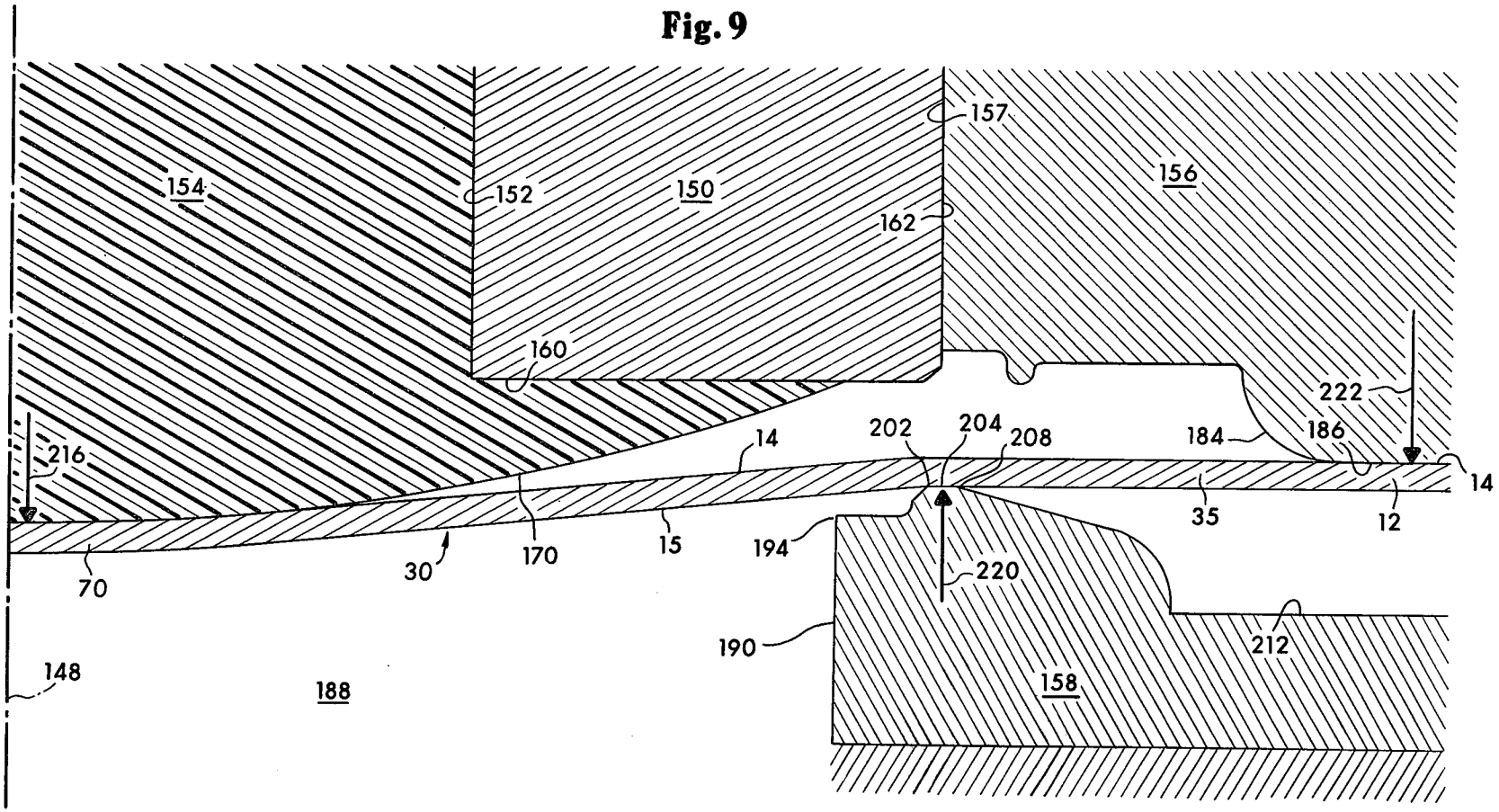
FIG. 9 is a cross-sectional side elevational view of the apparatus of FIG. 8 in a subsequent forming position.

Then, as shown in FIG. 9, after further continued downward movement of the upper tool members, the outermost surface 186 of the tool member 156 engages the upper surface 14 of the central panel portion 12 of the end member to initiate forming of the flange portion 35 by oppositely directed forming forces, as indicated by arrows 220, 222, applied through the laterally spaced forming surfaces 186 and 204. Thereafter, further forming of the central portion 70, the tab portion 30 and the flange portion 35 continues without initiating of the forming of the score groove means 37, 58 until surface 160 and forming edge 164 engage the upper surface 14 of the end member, shown in FIG. 10, whereupon the forming of the inner and outer score groove means 37 & 58 are simultaneously initiated by oppositely directed forming forces as indicated by arrows 220, 224. The forming of the central portion 70, the flange portion 35, and the inner and outer score groove means 37, 58 then continue simultaneously with the formation of score groove means 54 being subsequently initiated when surface 176 subsequently engages the then downwardly deflected and partially formed flange portion 35.

Figure 11:
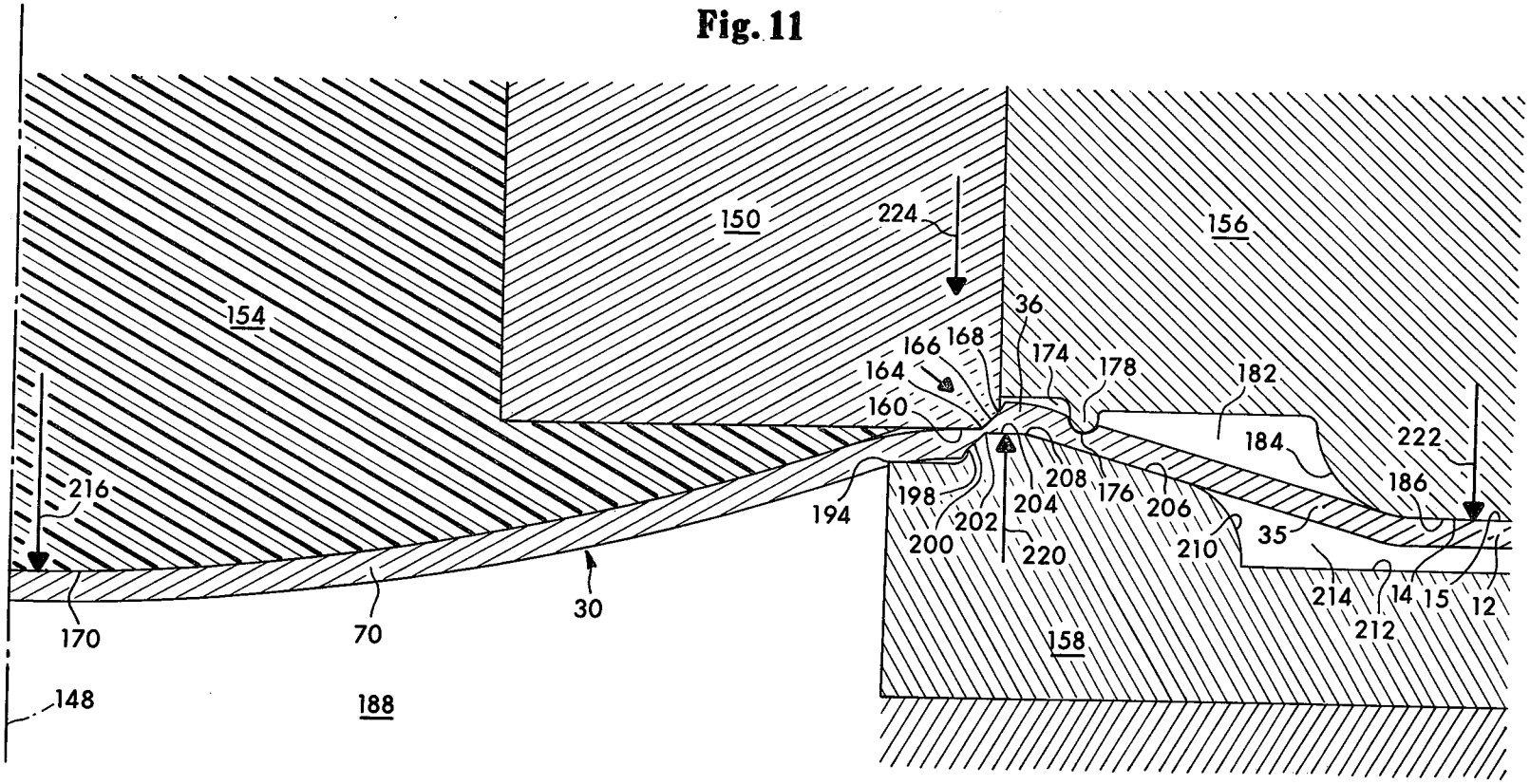
FIG. 11 is a cross-sectional side elevational view of the apparatus of FIG. 10 in a final forming position.

During the final portion of the forming operation, forming surfaces and edges 160, 164, 166, 168, 170, 176, 184, 186, 198, 200, 202, 204, 206, 208 & 210 are effective to complete the formation of the tab portion 30, the flange portion 35, and the score groove means 37, 54 & 58 as shown in FIG. 11 with clearance gaps provided at 174, 182, 188 and 214.

Referring now to FIGS. 12–19, a method of manufacture of the container end member embodiment of FIGS. 6–7 is illustrated in connection with modifications of the forming tool means of FIGS. 8–11 in that the forming tool member 154 has been removed and forming tool 150 made solid without cavity 152, the forming tool means otherwise being the same as previously described.

Figure 12:
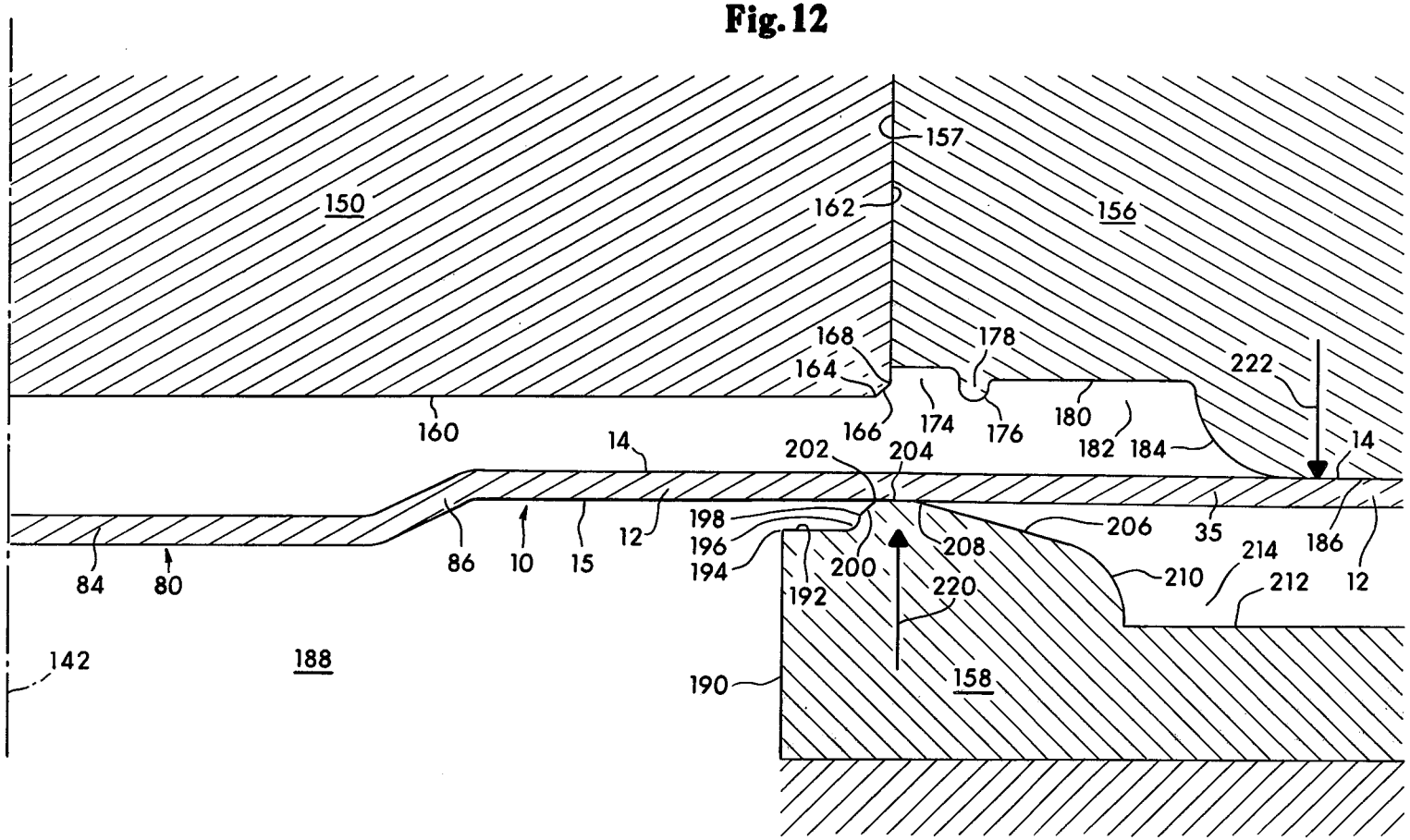
FIG. 12 is a cross-sectional side elevational view of a portion of apparatus for forming the container end member of FIGS. 6 and 7.

As shown in FIG. 12, a partially preformed end member 10, having preformed rim portions 16 & 19 and indentation means 80 in the flat central wall portion 12, is mounted in proper axially aligned relationship to and between upper tooling members 150 & 156 and lower tooling member 158 with the partially formed end member supported on surface 204 of the lower tooling member 158. Then, the tool members 150, 156 are moved downwardly relative to the lower tool member 158 whereupon the surface 186 first engages the upper surface 14 of end member 10 to exert a downwardly directed force thereon in the direction of the arrow 222 with an opposite upwardly directed force being exerted on the inner surface 15 through surface 204 in the direction of arrow 220 to begin formation of flange portion 35.

Figure 13:
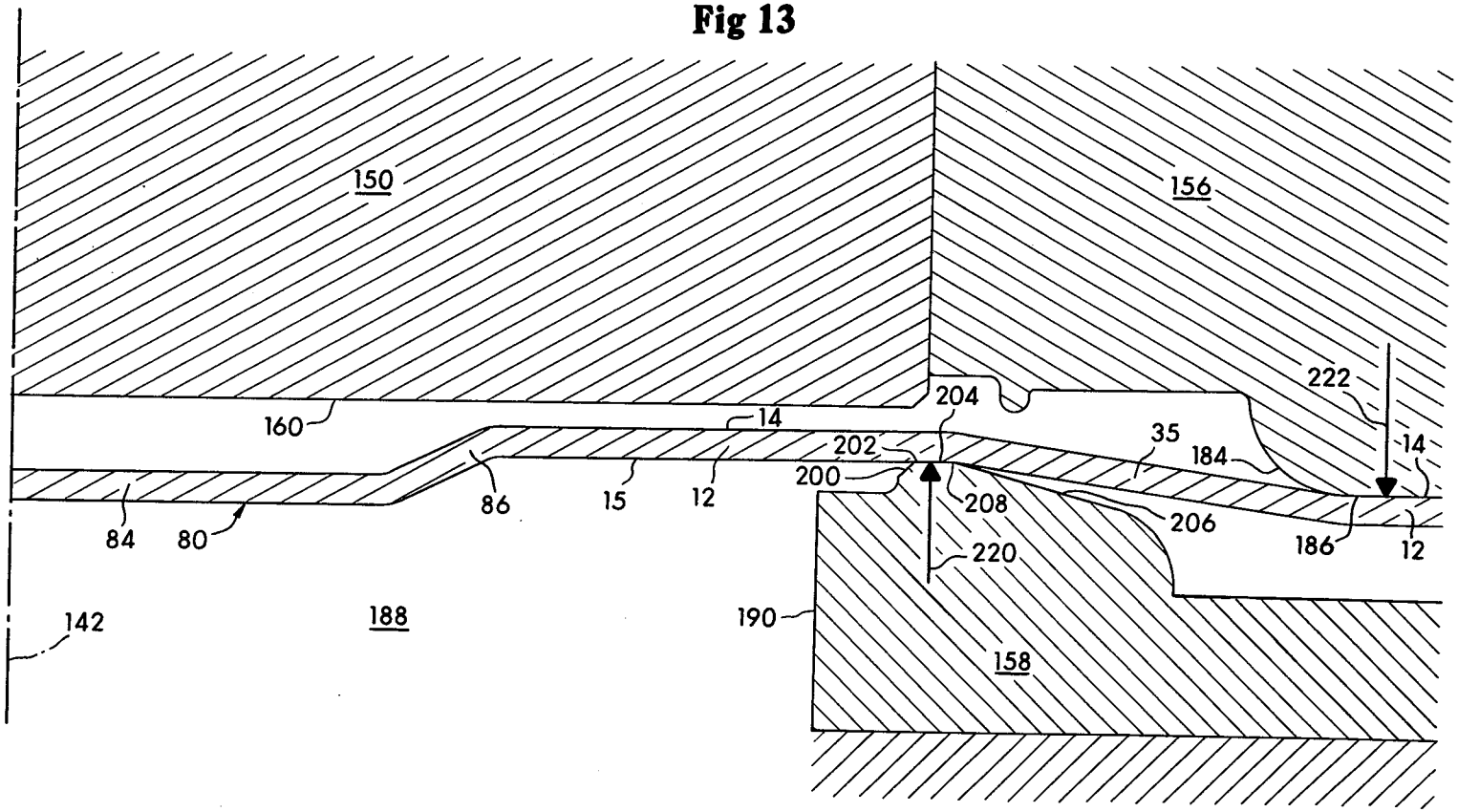
FIG. 13 is a cross-sectional side elevational view of the apparatus of FIG. 12 in a subsequent forming position.

As the tools are further closed, FIG. 13, the flange portion 35 is inclined by bending between surfaces 186 & 204. The bending forces are applied only through surfaces 186 and 204, 184, and no other part of the central portion 12 is then subject to forming forces.

Figure 14:
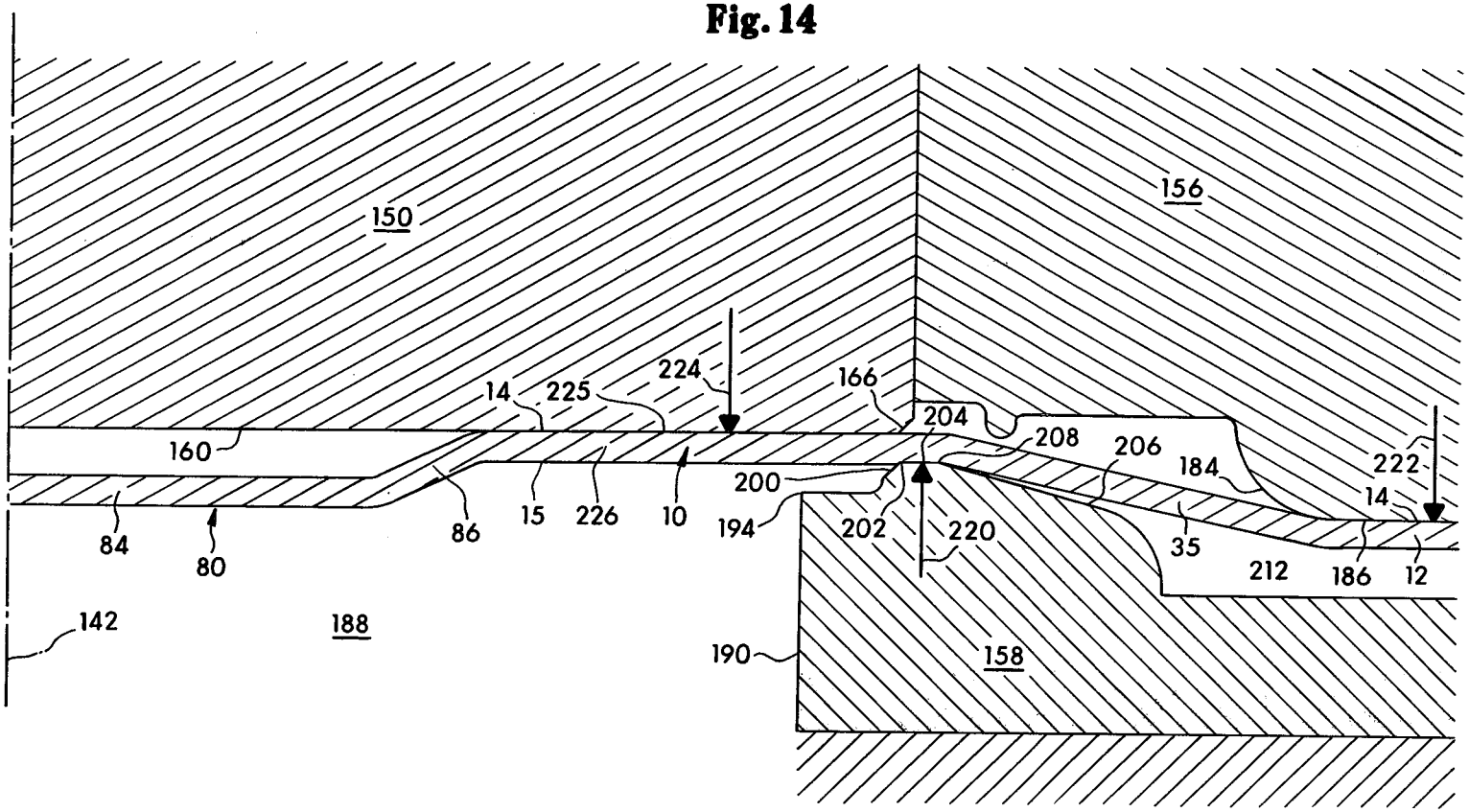
FIG. 14 is a cross-sectional side elevational view of the apparatus of of FIG. 13 in a subsequent forming position.

Thereafter, as the tools are further closed, FIG. 14, the flat upper surface portion 225 of the flange portion 226, extending between the preformed indentation portion 80 and the then formed flange portion 35, is engaged and supported by the flat surface 160 of tool member 150 to apply additional forming forces therealong in the direction of arrow 224.

Figure 15:
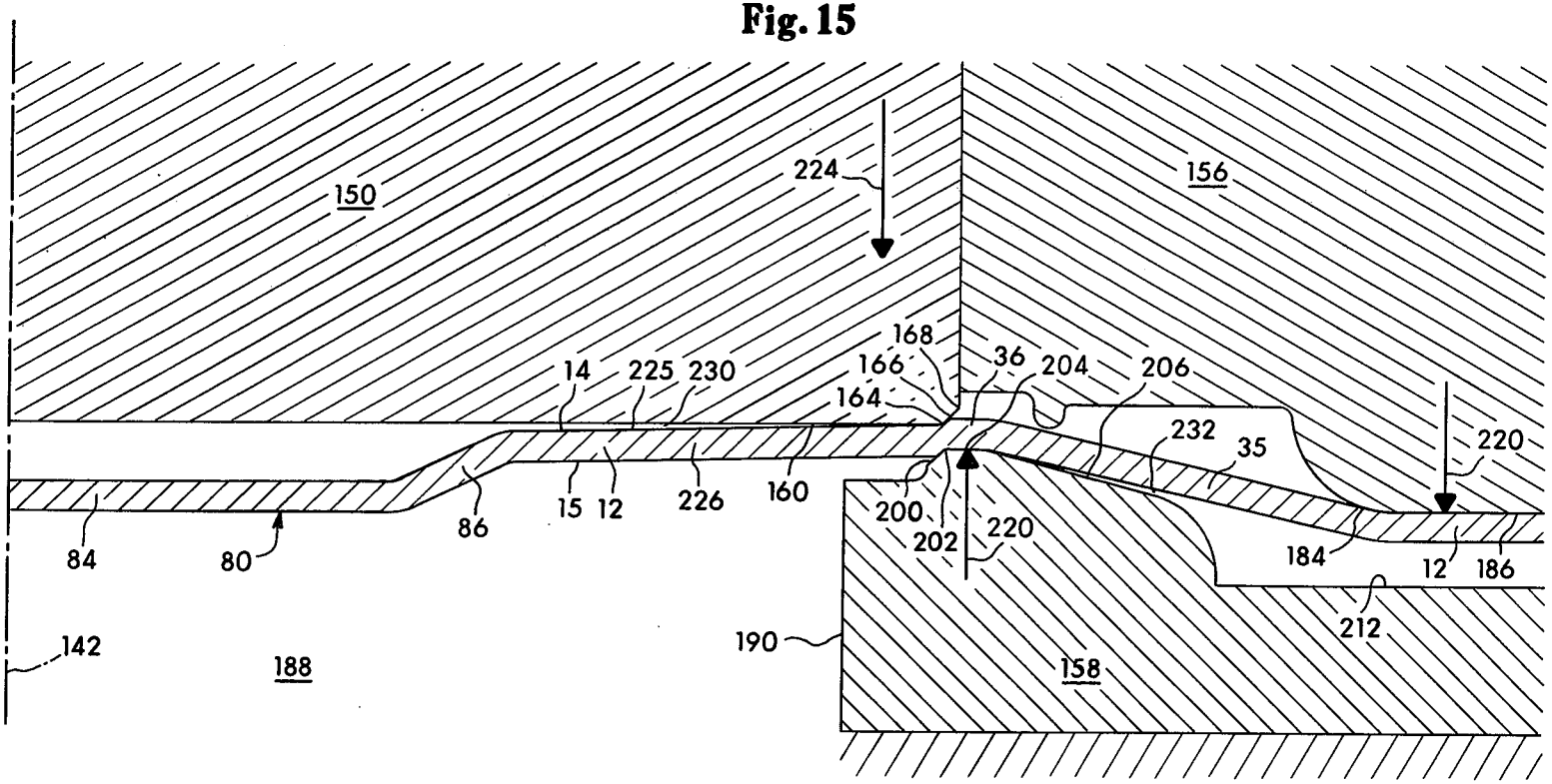
FIG. 15 is a cross-sectional side elevational view of the apparatus of FIG. 14 in a subsequent forming position.

Thereafter, as the closing movement of the tool members continues, the forming of the score grooves 37, 58 is initiated, as shown in FIG. 15, on the upper surface 14 at intersection 164 and adjacent portions of intersecting surfaces 160 and 166, and on the lower surface 15 at intersection 202 and adjacent portions of intersecting surfaces 200 and 204. At the same time, inner flange portion 226, which defines a tab portion connecting area between the area of indentation and the score grooves, is downwardly deflected by lateral inward metal flow from surface 200 without metal deformation therein to provide a clearance gap 230 between the forming surface 160 and the upper surface 225 of the flange portion 226, which defines the tab portion connecting area, substantially along the entire width of the upper surface of the flange portion and resulting in downward deflection of the preformed indentation portion 80 without metal deformation therein. The formation of the rim portion is initiated and further forming of flange portion 35 continues with the width of gap 232 between the bottom surface of the flange portion 35 and the surface 206 continuing to decrease due to bending forces 220, 222 and deflection caused by lateral outward metal flow from surface 166. At this time, the forming forces are being applied only through all of forming surfaces 204 and 186 and through portions of forming surfaces 200, 206, 184, 160 and 166.

Figure 16:
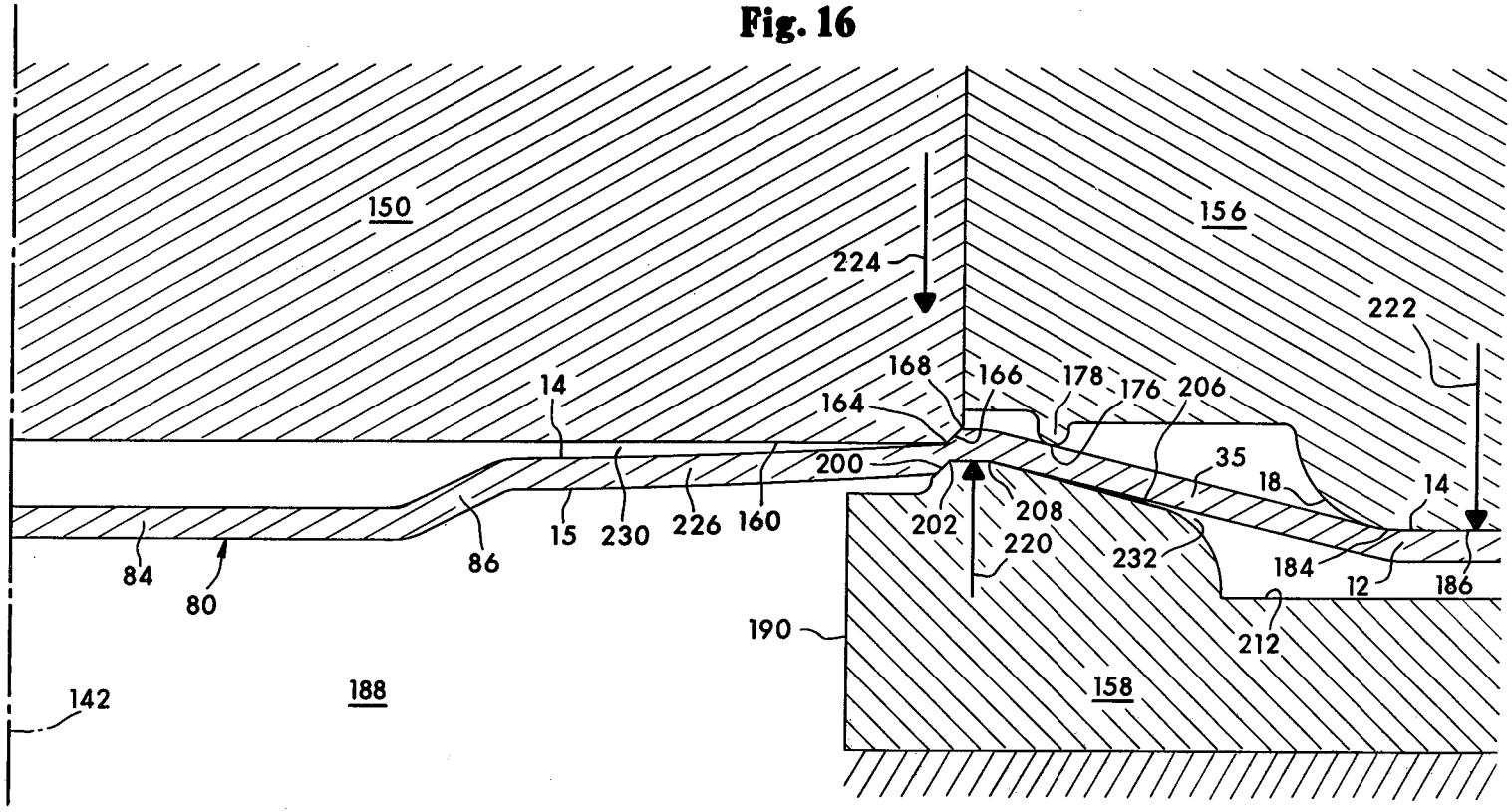
FIG. 16 is a cross-sectional side elevational view of the apparatus of FIG. 15 in a subsequent forming position.

Thereafter as the closing movement continues, FIG. 16, the score grooves 37, 58 are further formed with forming surfaces 166, 200 being substantially fully engaged with the outer and inner surfaces 14, 15 of the end member, whereat the surface 176 of forming rib 178 first engages the outer surface of flange portion 35 which has then been substantially, e.g. 60 to 80% completely formed as indicated by the relatively narrow width of gap 232. At this time, the inner flange portion 226 has been further downwardly deflected relative to forming surface 160, as indicated by the increased width of gap 230, by further lateral inward metal flow relative to surface 200 without metal deformation therein resulting in further axial downward displacement of the preformed indentation portion 80 without metal deformation therewithin.

Figure 17:
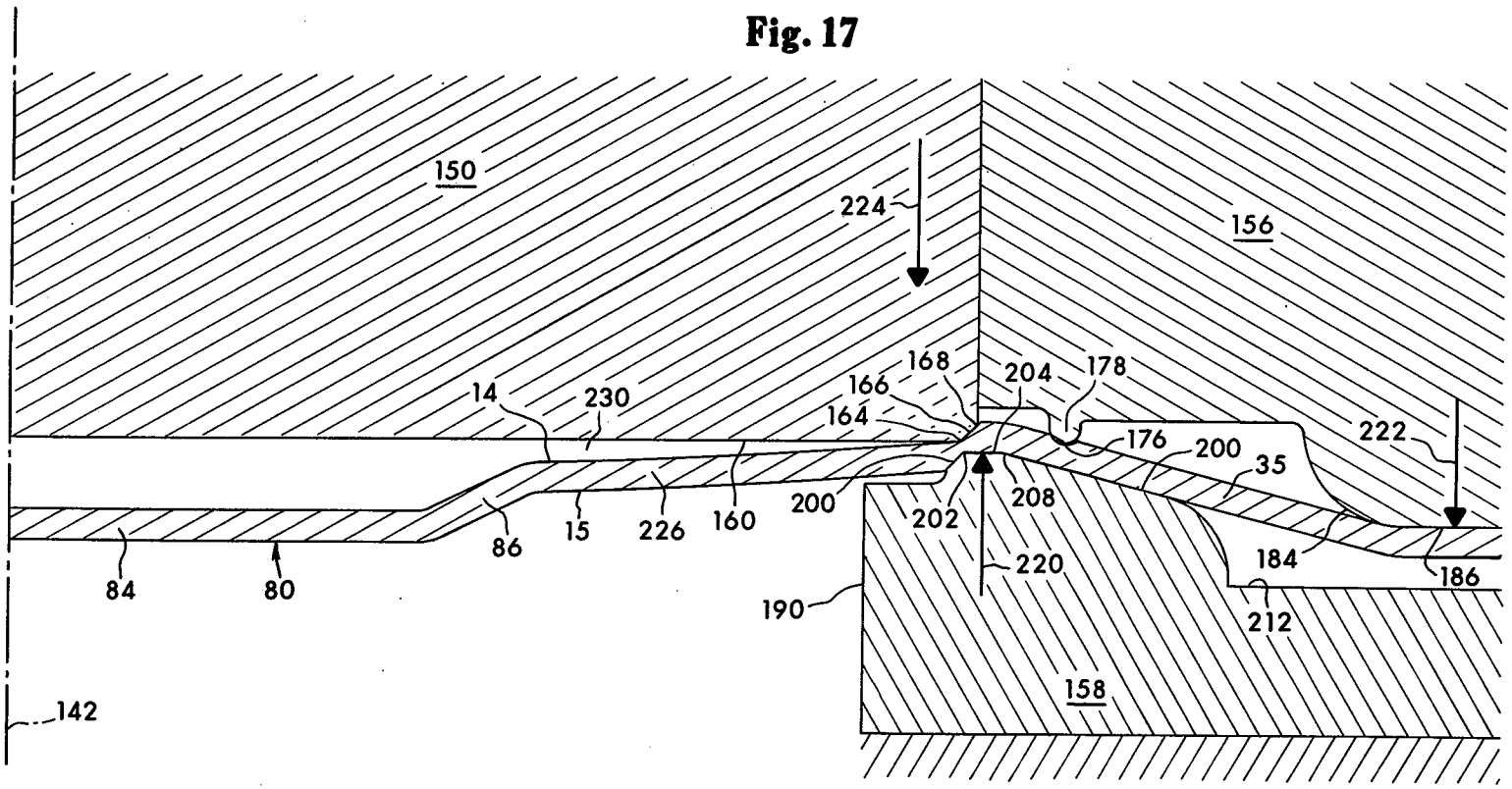
FIG. 17 is a cross-sectional side elevational view of the apparatus of FIG. 16 in a subsequent forming position.

Thereafter, as the closing movement of the tool members continues, the formation of the score groove 54 is initiated, FIG. 17, and the forming of the upper portion of the flange portion 35 is substantially completed by engagement with surface 200 with the rib 178 and surface 176 effectively blocking further lateral outward flow of metal therebeyond. The lower portion of flange portion 35 continues to be downwardly displaced and formed about surface 184. The forming of score grooves 37, 58 continues with lateral inward flow of metal relative to surface 200 causing further deflection of inner flange portion 226 relative to forming surface 160, as indicated by the increased width of gap 230, and causing further downward displacement of the preformed indentation portion 80 without metal deformation therewithin.

Figure 18:
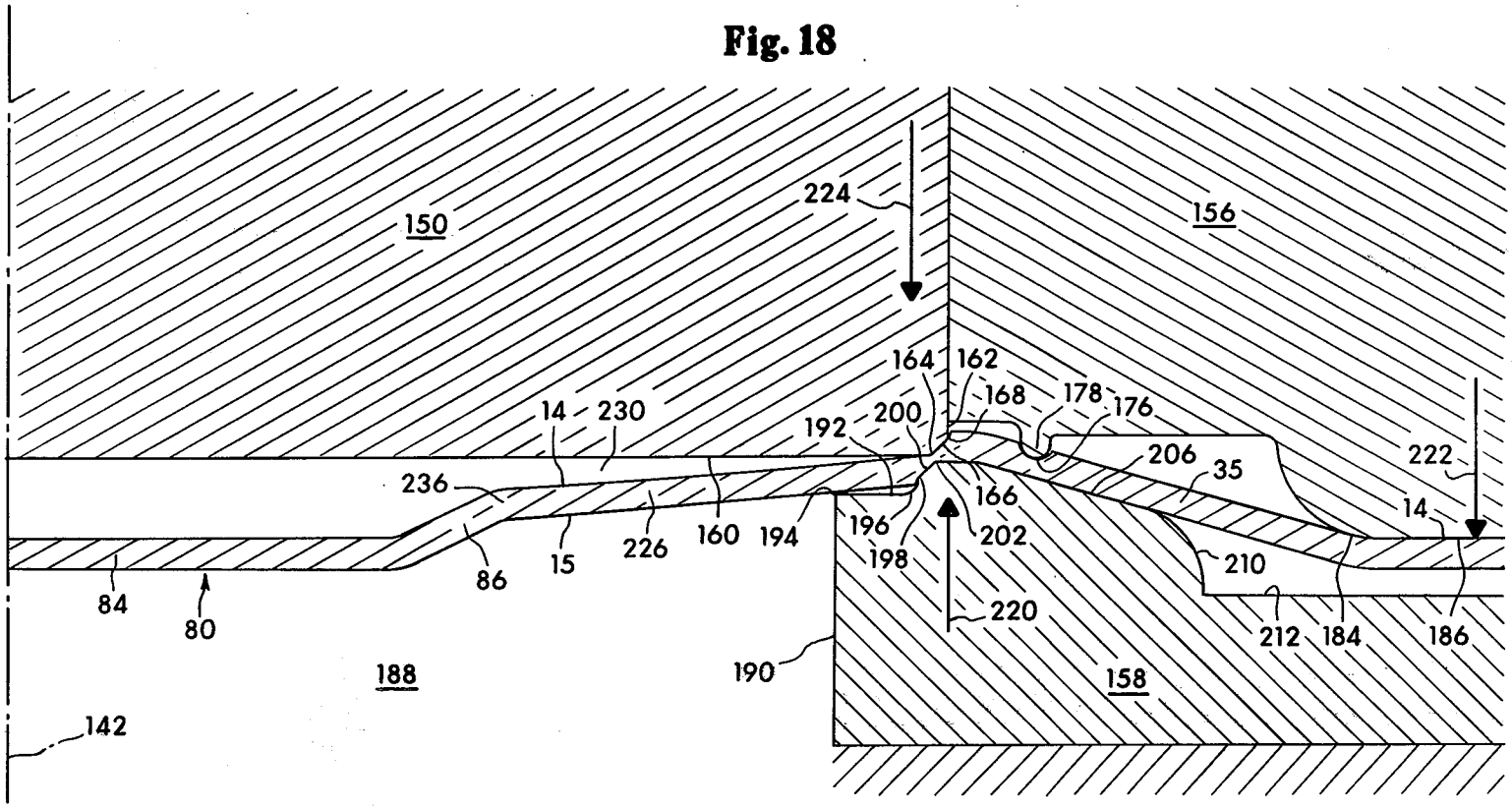
FIG. 18 is a cross-sectional side elevational view of the apparatus of FIG. 17 in a subsequent forming position.

Thereafter, as the closing movement of the tool members continues, FIG. 18, the formation of the score grooves 37, 54 & 58 continues with initiation of flow of metal around intersections 168, 198 toward surfaces 162, 196. At this time, the bottom surface of flange portion 226 engages the intersection 194 of surface 192 and the side surface 190. Again, the flange portion 226 is further deflected away from surface 160 by lateral inward metal flow relative to surface 200, as indicated by the increased width of gap 230, and the preformed indentation portion 80 is further axially downwardly displaced without metal deformation except to the extent of perhaps some additional bending at the junction 236 between inner flange portion 226 and side wall portion 86. Thus, the initial engagement and support of outer surface 225 of flange portion 226 by forming surface 160 is gradually substantially terminated. Formation of the lower portion of flange portion 35 continues about surface 184 and some bending about surface 210 is initiated.

Figure 19:
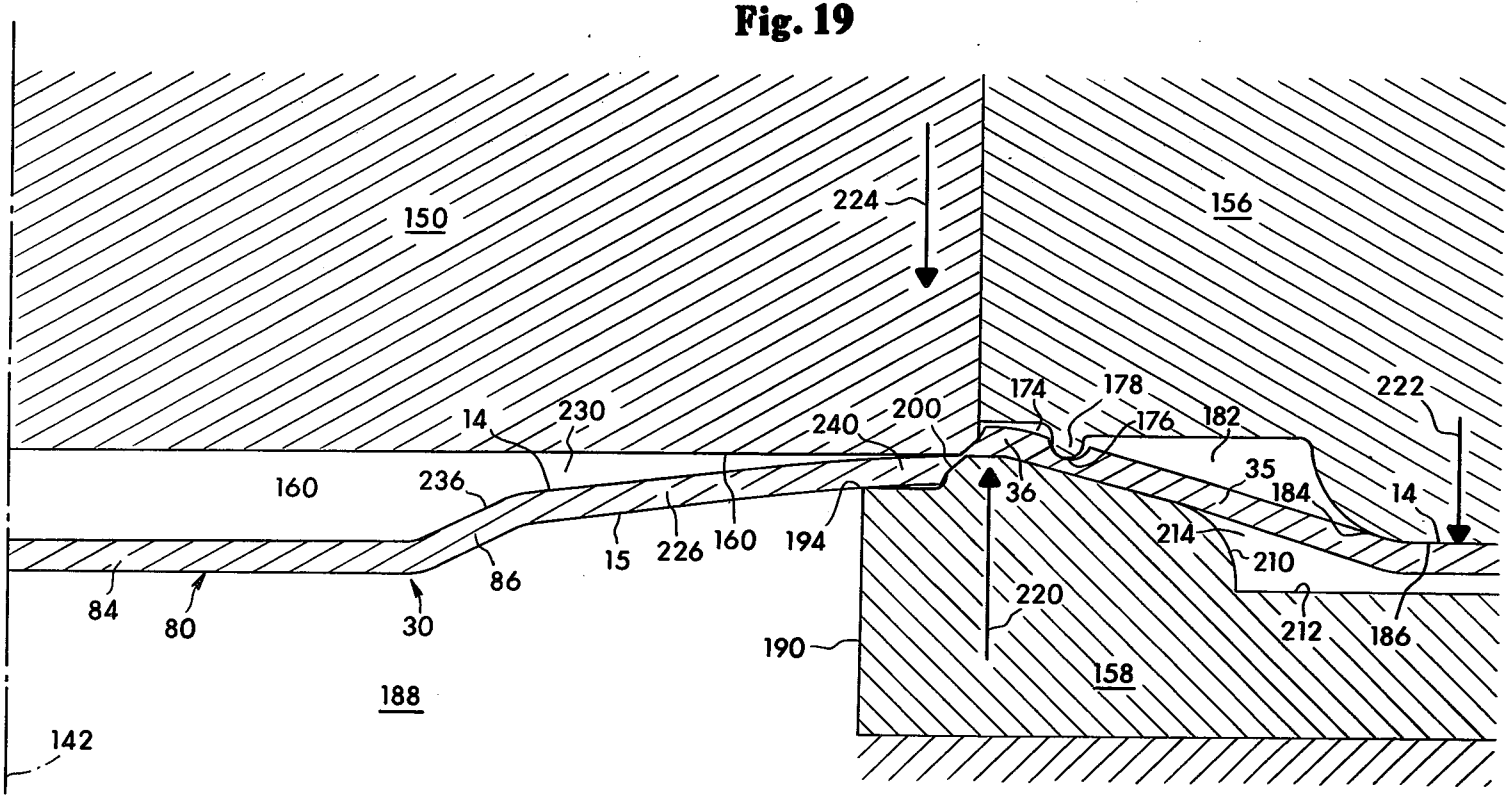
FIG. 19 is a cross-sectional side elevational view of the apparatus of FIG. 18 in a final forming position.

Thereafter, during the final closing movement of the tool members, the formation of the tab portion 30, the flange portion 35 and score grooves 37, 54 & 58 is completed, as shown in FIG. 19. During the final movement of the tools, the outer part 240 of inner flange portion 226 is slightly outwardly curved due to engagement of the lower surface at intersection 194 and the connecting portion between flange portions 86 & 226 may be slightly further bent. The bending of the lower portion of flange portion 35 about surfaces 184 and 210 is completed. The clearance gaps 174, 182, 214, still provide clearance between the adjacent upper and lower surfaces 14, 15 of the central panel portion 12 with the indentation means 80 remaining in spaced relationship to adjacent tool surfaces.

Thus both the tab means of the can end member embodiments of FIGS. 1–5 and 6–7 are manufactured by the sequential steps of first forming the tab portion 30 at least in part; then beginning the forming of the flange portion 35 and completing a substantial part of the forming of the flange portion; then beginning the forming of the score groove means 37, 58 and completing a substantial part of the forming of the score groove means while continuing to form the flange portion 35 and further forming the tab portion 30; and then beginning the forming of score groove means 54 and forming the score groove means 54 while completing the forming of the tab portion 30, the flange portion 35, and the score groove means 37, 58.

Figure 10:
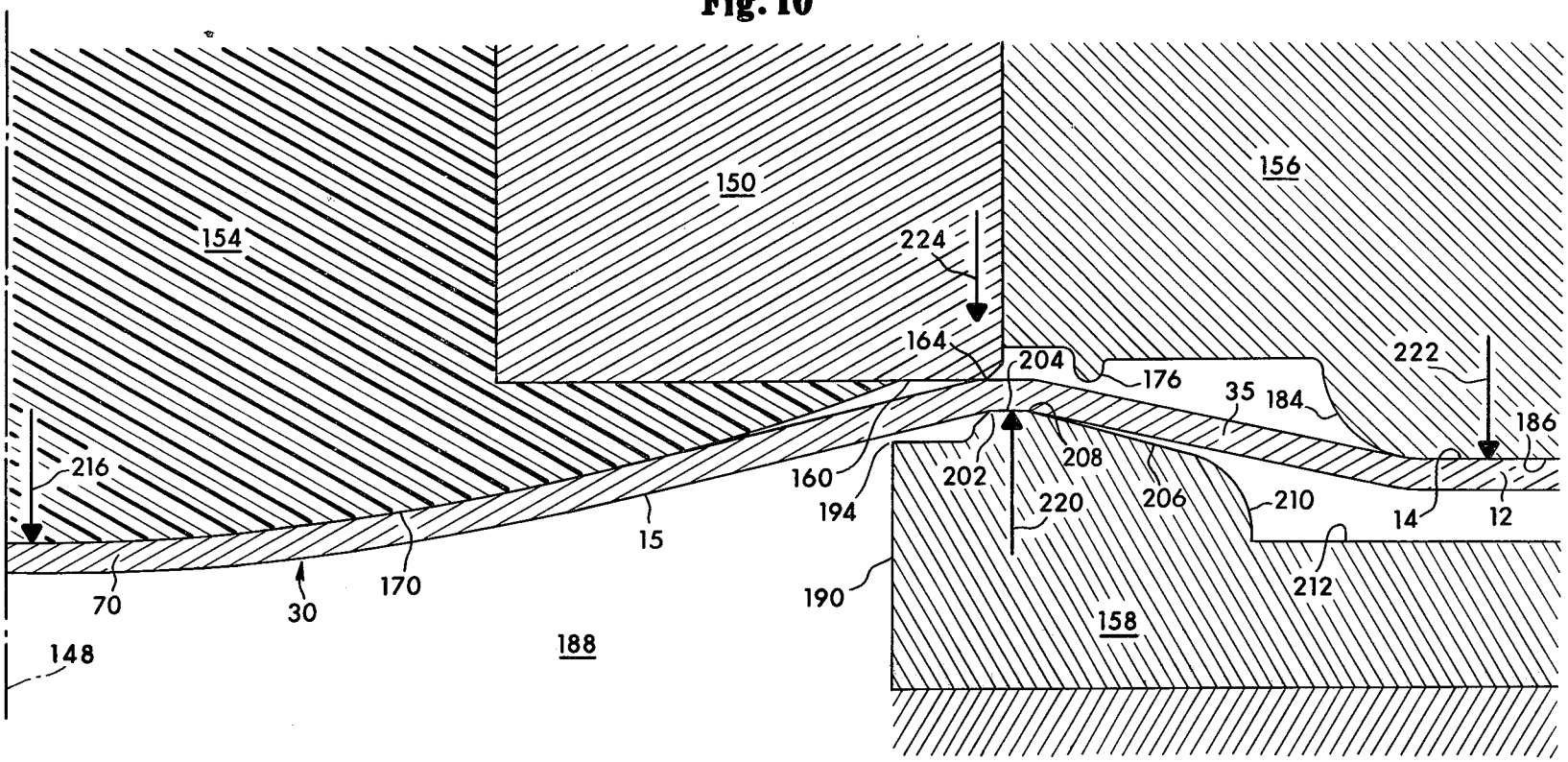
FIG. 10 is a cross-sectional side elevational view of the apparatus of FIG. 9 in a subsequent forming position.

As indicated by the drawing, the location of the tool members in FIGS. 9, 10 & 11 correspond to the location of the tool members in FIGS. 12, 14 & 19, respectively, and the tool members of FIGS. 9–11 have intermediate positions (not shown) which correspond to the positions of the tool members of FIGS. 12–19.

As illustrated by the varying relative positions of the tool members in FIGS. 8–19, the forming surface 186 for flange portion 35 moves approximately 54% of the total forming movement between the positions of FIGS. 12 & 13, approximately 23% of the total movement between the positions of FIGS. 13 & 14, approximately 5.67% of the total movement between the positions of FIGS. 14 & 15, approximately 5.67% of the total movement between the position of FIGS. 15 & 16; approximately 5.67% of the total movement between the positions of FIGS. 16 & 17, approximately 2.92% of the total movement between the positions of FIGS. 17 & 18, and approximately 2.92% of the total movement between the positions of FIGS. 18 & 19.

The total forming movement of forming surface 170 for tab portion 30 comprises approximately 28.6% between the positions of FIGS. 8 & 9; approximately 57.2% between the positions of FIGS. 9 & 10; and approximately 14.3% between the positions of FIGS. 10 & 11. Approximately 7.15% of the total forming movement occurs between the positions of FIGS. 14 & 16 and also between the positions of FIGS. 16 & 19.

The total forming movement of the forming surfaces 164, 166 for the first and second score groove means 37, 58 comprises approximately 25% between the positions of FIGS. 14 & 15; approximately 25% between the positions of FIGS. 15 & 16; approximately 25% between the positions of FIGS. 16 & 17; approximately 12.5% between the positions of FIGS. 17 & 18; and approximately 12.5% between the positions of FIGS. 18 & 19.

The total forming movement of the forming surface 176 for the third score groove means 54 comprises approximately 50% between the positions of FIGS. 16 & 17; approximately 25% between the positions of FIGS. 17 & 18; and approximately 25% between the positions of FIGS. 18 & 19.

Thus, in general, the method of forming the tab means 30 may be further defined as first at least partially forming a central part of the tab portion before forming any other part of the tab means either by the method of FIGS. 8–11, wherein approximately 25% of the forming of the tab portion has been completed as shown in FIG. 9, or by preforming the indentation means 80; thereafter initiating forming of the connecting flange portion 35, FIGS. 9 & 12, and partially forming the connecting flange portion before initiating the forming of any other part of the tab means other than the tab portion as shown in FIGS. 10 & 14; and thereafter initiating the forming of the first and second score groove means 37, 58 and completing the forming of the first and second score groove means while completing the forming of the tab portion 30 and the connecting flange portion 35 as shown in FIGS. 11 & 19. More specifically, the forming of the flange portion 35 is at least 50% completed and, more preferably at least approximately 75% completed before initiation of the forming of the first and second score groove means 37, 58. In addition, the forming of the third score groove means 54 is not initiated until the forming of the flange portion 35 is at least approximately 80% completed and, more preferably at least approximately 85% completed with approximately 50% of the forming of the first and second score groove means having been completed and more than at least approximately 80% and preferably more than approximately 90% of the forming of the tab portion 30 having been completed.

The presently preferred method of forming the end member of FIGS. 12–19 may be futher defined as comprising the sequential steps of first completely forming the center portion of tab portion 30 by forming the indentation means 80; then initiating forming of the flange portion 35, as shown in FIG. 12, and forming more than 50% of the flange portion 35, e.g., 77% of the flange forming tool movement having been completed between the positions of FIGS. 12 & 14; then initiating forming of the score groove means 37 & 58, as shown in FIG. 14, and forming approximately 50% of the score groove means 37 & 58 before initiating forming of score groove means 54 at the position of FIG. 16, i.e., approximately 50% of the score groove means forming surface movement between the positions of FIG. 14 and FIG. 19 having been completed at position 16, while continuing to form the flange portion 35 and having completed at least approximately 80% of the formation of the flange portion 35 before initiating forming of score groove means 54, e.g., approximately 88% of the flange forming surface movement between the positions of FIG. 12 and FIG. 19 having been completed at the position of FIG. 16; and then initiating the forming of score groove means 54 at the position of FIG. 16 and completing the forming of score groove means 54 while completing approximately the final 10% to 12% of the forming of flange portion 35, approximately the final 50% of the forming of the score groove means 37 & 58, and completing the forming of tab portion 30.

The further forming of the tab portion 30 is initiated at the same time as the forming of the first and second score groove means 37, 58 is initiated as shown by FIG. 14. The further forming of the tab portion 30 is approximately 50% completed before the initiation of the forming of the third score groove means 54 at the position of FIG. 16 and is approximately 50% further completed between the position of FIG. 16 and the final position of FIG. 19.

While the inventive concepts have been herein disclosed by reference to an illustrative and presently preferred embodiment of the invention, it is contemplated that the inventive concepts may be variously otherwise embodied in alternative forms of container end members and methods of manufacture thereof. Thus, it is intended that the appended claims be construed to include alternative forms of container end members and methods of manufacture thereof except insofar as precluded by the prior art.

What is claimed is:

1. The method of forming a metallic can end blank member, having a preformed outer annular rim portion and a central end wall portion, to provide an integral hinged opening tab means in the central end wall portion including: an integral axially inwardly displaced formed tab portion; an integral axially outwardly displaced formed flange portion next adjacent and extending along the periphery of the formed tab portion; and continuous integral score groove means in the flange portion and extending along the periphery of the formed tab portion; and the method comprising:

first, prior to initiation of any other forming steps, initiating metal forming of the tab portion by causing at least some axially inward displacement and partial forming of the tab portion including axial inward displacement of sufficient metal in the tab portion to sufficiently increase the strength of the metal in the tab portion to prevent buckling of the metal in the tab portion after initiation of any of the other forming steps;

secondly, after the first step, initiating metal forming of the flange portion including displacement of metal along the periphery of the tab portion relative to the central end wall portion;

thirdly, after initiation of the first and second steps, initiating metal forming of the score groove means including lateral displacement of metal in the flange portion along the periphery of the tab portion;

the forming of the tab portion continuing after the initiation and during the forming of the flange portion and the score groove means; and the forming of the flange portion being more than 50% completed before initiation of the forming of the first and second score groove means.

2. The invention as defined in claim 1 and wherein:

the tab portion being more than approximately 25% formed before initiation of the forming of the flange portion.

3. The invention as defined in claim 2 and wherein:

the tab portion being more than approximately 80% formed before initiation of the forming of the first and second score groove means.

4. The method of forming a metallic can end blank member, having a preformed outer annular rim portion and a central end wall portion, to provide an integral hinged opening tab means in the central end wall portion including: an integral axially inwardly displaced formed tab portion; an integral axially outwardly displaced formed flange portion next adjacent and extending along the periphery of the formed tab portion; and continuous integral score groove means in the flange portion and extending along the periphery of the formed tab portion; and the method comprising:

first, prior to initiation of any other forming steps, initiating metal forming of the tab portion by causing at least some axially inward displacement and partial forming of the tab portion including axial inward displacement of sufficient metal in the tab portion to sufficiently increase the strength of the metal in the tab portion to prevent buckling of the metal in the tab portion after initiation of any of the other forming steps;

secondly, after the first step, initiating metal forming of the flange portion including relative axial outward displacement of metal along the periphery of the tab portion relative to the central end wall portion;

thirdly, after initiation of the first and second steps, initiating metal forming of the score groove means including lateral displacement of metal in the flange portion along the periphery of the tab portion;

the forming of the tab portion continuing after the initiation and during the forming of the flange portion and the score groove means;

the final forming of at least a part of the tab portion and the complete forming of the flange portion and the complete forming of the score groove means being done during one continuous stroke of a forming press; and the central part of the tab portion being completely formed before initiation of the forming of the flange portion.

5. The method of forming a metallic can end blank member, having a preformed outer annular rim portion and a central end wall portion, to provide an integral hinged opening tab means in the central end wall portion including: an integral axially inwardly displaced formed tab portion; an integral axially outwardly displaced formed flange portion next adjacent and extending along the periphery of the formed tab portion; and continuous integral score groove means in the flange portion and extending along the periphery of the formed tab portion; the score groove means comprising a first and second score groove means next adjacent the tab portion and a third score groove means laterally outwardly spaced relative to the first and second score groove means; and the method comprising:

first, prior to initiation of any other forming steps, initiating metal forming of the tab portion by causing at least some axially inward displacement and partial forming of the tab portion including axial inward displacement of sufficient metal in the tab portion to sufficiently increase the strength of the metal in the tab portion to prevent buckling of the metal in the tab portion after initiation of any of the other forming steps;

secondly, after the first step, initiating metal forming of the flange portion including relative axial outward displacement of metal along the periphery of the tab portion relative to the central end wall portion;

thirdly, after initiation of the first and second steps, initiating metal forming of the score groove means including lateral displacement of metal in the flange portion along the periphery of the tab portion;

the forming of the tab portion continuing after the initiation and during the forming of the flange portion and the scope groove means;

initiating metal forming of the first and second score groove means prior to initiating forming of the third score groove means; and the forming of the flange portion having been at least approximately 70% completed before initiation of the forming of the score groove means.

6. The invention as defined in claim 5 and wherein:

the forming of the connecting flange portion and the first and second score means and at least the completion of the forming of the tab portion occurring during one continuous stroke of a press.

7. The invention as defined in claim 6 and wherein:

the central part of the tab portion being completely formed before initiation of the forming of the flange portion.

8. The invention as defined in claim 7 and wherein:

the tab portion being more than approximately 25% formed before initiation of the forming of the flange portion.

9. The invention as defined in claim 8 and wherein:

the tab portion being more than approximately 80% formed before initiation of the forming of the first and second score groove means.

10. The invention as defined in claim 9 and wherein:

the tab portion being more than approximately 90% formed before initiation of the forming of the third score groove means.

11. The invention as defined in claim 16 and wherein:

the first and second score groove means being at least approximately 50% formed before initiation of forming of the third score groove means.

12. The invention as defined in claim 11 and wherein:

the connecting flange portion being at least approximately 85% formed before initiation of forming of the third score groove means.

13. The invention as defined in claim 5 and wherein:

the initial metal forming of the tab portion being completed prior to initiating metal forming of the flange portion; and additional metal forming of the tab portion being initiated after the completion of at least approximately 70% of the forming of the flange portion.

14. The invention as defined in claim 13, and wherein:

the additional metal forming of the tab portion being approximately 50% completed before initiation of metal forming of the third score groove means.

15. The method of forming a metallic can end blank member, having a preformed outer annular rim portion and a central end wall portion, to provide an integral hinged opening tab means in the central end wall portion including: an integral axially inwardly displaced formed tab portion; an integral axially outwardly displaced formed flange portion next adjacent and extending along the periphery of the formed tab portion; and continuous integral score groove means in the flange portion and extending along the periphery of the formed tab portion; the score groove means comprising a first and second score groove means next adjacent the tab portion and a third score groove means laterally outwardly spaced relative to the first and second score groove means; and the method comprising:

first, prior to initiation of any other forming steps, initiating metal forming of the tab portion by causing at least some axially inward displacement and partial forming of the tab portion including axial inward displacement of sufficient metal in the tab portion to sufficiently increase the strength of the metal in the tab portion to prevent buckling of the metal in the tab portion after initiation of any of the other forming steps;

secondly, after the first step, initiating metal forming of the flange portion including relative axial outward displacement of metal along the periphery of the tab portion relative to the central end wall portion;

thirdly, after initiation of the first and second steps, initiating metal forming of the score groove means including lateral displacement of metal in the flange portion along the periphery of the tab portion;

the forming of the tab portion continuing after the initiation and during the forming of the flange portion and the score groove means;

initiating metal forming of the first and second score groove means prior to initiating forming of the third score groove means; and the subsequent step, after completion of the forming of the tab portion, the connecting flange portion and the score groove means, of convexly axially outwardly displacing the central end wall portion relative to the outer annular rim portion.

16. The method of forming a metallic can end blank member, having a preformed outer annular rim portion and a central end wall portion, to provide an integral hinged opening tab means in the central end wall portion including: an integral axially inwardly displaced formed tab portion; an integral axially outwardly displaced formed flange portion next adjacent and extending along the periphery of the formed tab portion; and continuous integral score groove means in the flange portion and extending along the periphery of the formed tab portion; the score groove means comprising a first and second score groove means next adjacent the tab portion and a third score groove means laterally outwardly spaced relative to the first and second score groove means; and the method comprising:

first, prior to initiation of any other forming steps, initiating metal forming of the tab portion by causing at least some axially inward displacement and partial forming of the tab portion including axial inward displacement of sufficient metal in the tab portion to sufficiently increase the strength of the metal in the tab portion to prevent buckling of the metal in the tab portion after initiation of any of the other forming steps;

secondly, after the first step, initiating metal forming of the flange portion including relative axial outward displacement of metal along the periphery of the tab portion relative to the central end wall portion;

thirdly, after initiation of the first and second steps, initiating metal forming of the score groove means including lateral displacement of metal in the flange portion along the periphery of the tab portion;

the forming of the tab portion continuing after the initiation and during the forming of the flange portion and the score groove means;

initiating metal forming of the first and second score groove means prior to initiating forming of the third score groove means; and further comprising the subsequent step, after completion of the forming of the tab portion, the connecting flange portion, and the score groove means, of:

holding the annular outer rim portion in fixed sealed relationship to a source of high pressure air;

applying high pressure air to the inner surface of the central end wall portion; and simultaneously convexly axially outwardly deforming the central end wall portion relative to the outer annular rim portion and testing the container end member for defects affecting the sealed integrity of the container end member.

17. The method of forming a metallic can end blank member, having a preformed outer annular rim portion and a central end wall portion, to provide an integral hinged opening tab means in the central end wall portion including: an integral axially inwardly displaced formed tab portion; an integral axially outwardly displaced formed flange portion next adjacent and extending along the periphery of the formed tab portion; and continuous integral score groove means in the flange portion and extending along the periphery of the formed tab portion; and the method comprising:

first, prior to initiation of any other forming steps, initiating metal forming of the tab portion by causing at least some axially inward displacement and partial forming of the tab portion including axial inward displacement of sufficient metal in the tab portion to sufficiently increase the strength of the metal in the tab portion to prevent buckling of the metal in the tab portion after initiation of any of the other forming steps;

secondly, after the first step, initiating metal forming of the flange portion including relative axial outward displacement of metal along the periphery of the tab portion relative to the central end wall portion;

thirdly, after initiation of the first and second steps, initiating metal forming of the score groove means including lateral displacement of metal in the flange portion along the periphery of the tab portion;

the forming of the tab portion continuing after the initiation and during the forming of the flange portion and the score groove means; and the first step further comprising completely permanently forming an inwardly extending area of indentation in the tab portion in peripherally inwardly spaced relationship to the unformed flange portion; and after initiation of metal forming of the flange portion and during initiating of metal forming of the score groove means, inwardly deflecting a tab portion connecting area between the area of indentation and the score groove means without any further forming of the area of indentation.

18. The invention as defined in claim 17 and wherein:

during initiation of metal forming of the score groove means, engaging and supporting the outer surface of the tab portion connecting area between the area of indentation and the score groove means.

19. The invention as defined in claim 18 and wherein:

after initiation of the forming of the score groove means, gradually substantially terminating engagement and support of the outer surface of the tab portion connecting area between the area of identation and the score groove means.

20. The method of forming a metallic can end blank member, having a preformed outer annular rim portion and a central end wall portion, to provide an integral hinged opening tab means in the central end wall portion including: an integral axially inwardly displaced formed tab portion; an integral axially outwardly displaced formed flange portion next adjacent and extending along the periphery of the formed tab portion; and continuous integral score groove means in the flange portion and extending along the periphery of the formed tab portion; and the method comprising:

first, prior to initiation of any other forming steps, initiating metal forming of the tab portion by causing at least some axially inward displacement and partial forming of the tab portion including axial inward displacement of sufficient metal in the tab portion to sufficiently increase the strength of the metal in the tab portion to prevent buckling of the metal in the tab portion after initiation of any of the other forming steps;

secondly, after the first step, initiating metal forming of the flange portion including relative axial outward displacement of metal along the periphery of the tab portion relative to the central end wall portion;

thirdly, after initiation of the first and second steps, initiating metal forming of the score groove means including lateral displacement of metal in the flange portion along the periphery of the tab portion;

the forming of the tab portion continuing after the initiation and during the forming of the flange portion and the score groove means;

the final forming of at least a part of the tab portion and the complete forming of the flange portion and the complete forming of the score groove means being done during one continuous stroke of a forming press;

and wherein the first step further comprising:

first engaging the central outer surface of the unformed tab portion with a forming surface having a contour corresponding to the contour of the tab portion to be formed;

then permanently inwardly forming a central area of the tab portion in peripherally inwardly spaced relationship to the unformed flange portion and inwardly deflecting a tab portion connecting area between the central area and the score groove means; and during forming of the flange portion and prior to initiation of forming of the score groove means, further permanently inwardly forming the tab portion by progressively enlarging the area of engagement with the forming surface while continuing to progressively further deflect and reduce the width of the tab portion connecting area.

21. The invention as defined in claim 20 and wherein:

after initiation of the forming of the score groove means and during the forming of the score groove means, further permanently inwardly forming the tab portion by progressively enlarging the area of engagement with the forming surface while continuing to progressively further deflect and reduce the width of the tab portion connecting area.

* * * * *